US005335799A

United States Patent [19]

Coudron

[11] Patent Number: 5,335,799

[45] Date of Patent: Aug. 9, 1994

[54] WALL-MOUNTED TOP SUPPORT

[76] Inventor: Douglas L. Coudron, 2200 Zanzibar La. N., Plymouth, Minn. 55447

[21] Appl. No.: 74,945

[22] Filed: Jun. 10, 1993

[51] Int. Cl.[5] ..... A47F 7/00

[52] U.S. Cl. ..... 211/65; 211/70.6; 211/87

[58] Field of Search ..... 211/65, 66, 87, 60.1, 211/68, 70.6, 70.8

[56] References Cited

U.S. PATENT DOCUMENTS

| | | | |
|---|---|---|---|
| 1,208,923 | 12/1916 | Dell | 211/65 |
| 1,445,029 | 2/1923 | Orrill | 211/65 |
| 1,637,782 | 8/1927 | Milligan | 211/65 |
| 2,423,292 | 7/1947 | Brown | 211/65 |
| 2,441,697 | 5/1948 | Gage | 248/110 |
| 2,757,787 | 8/1956 | Sergent | 206/1 |
| 3,197,169 | 7/1965 | Burrows | 248/359 |
| 3,421,632 | 1/1969 | Wood | 211/708 |
| 3,780,874 | 12/1973 | Stacy, Sr. | 211/65 |
| 4,286,717 | 9/1981 | Liesinger | 211/60 |
| 4,722,113 | 2/1988 | Olsson | 15/264 |
| 5,165,629 | 11/1992 | Breveglieri | 248/110 |

*Primary Examiner*—Robert W. Gibson, Jr.
*Attorney, Agent, or Firm*—Nawrocki, Rooney & Sivertson

[57] ABSTRACT

An apparatus for supporting at least one mop having an elongated handle and a mop head. The mop holder includes an upper support member having a first backing plate for affixing the upper support member to a wall or vertical surface. The first backing plate further including means for supporting an elongated handle of a mop in a generally vertical position projecting outwardly therefrom. The mop holder also includes a lower support member having a second backing plate for affixing the lower support member to a wall or vertical surface. The second backing plate further includes means for supporting a mop head fixedly attached and projecting outwardly therefrom. In use, the upper support member and the lower support member are mounted to the wall or the vertical surface at a distance spaced generally vertically so that the members cooperate with each other to support both the elongated handle and the mop head.

16 Claims, 1 Drawing Sheet

WALL-MOUNTED TOP SUPPORT

TECHNICAL FIELD

The present invention relates to a holder or support for objects with elongated handles. More narrowly, it is directed to a wall-mounted support for conveniently storing at least one mop wherein the strands of the mop head hang freely to facilitate drying.

BACKGROUND OF THE INVENTION

Devices for holding and storing household cleaning implements or hand tools having an elongated cylindrical handle are generally known. Such devices are designed and utilized for keeping such implements and tools organized and secure while easily accessible in an out-of-the-way location.

As disclosed by Liesinger (U.S. Pat. No. 4,286,717) and Breveglieri (U.S. Pat. No. 5,165,629), some devices for supporting such articles as tools and cleaning implements are designed to support the weight of the entire tool or implement by friction contact with the elongated cylindrical handle. These devices include a biasing means or other means for firmly grasping the elongated handle with sufficient force to prevent slippage due to the weight of the tool or implement. It is believed such devices would not support a wet commercial mop which may weigh as much as 20–25 lbs.

The device disclosed by Liesinger includes a tubular member attached to a plate which has a passage and open ends to accommodate a portion of the handle of a tool or cleaning implement. A section of the tubular member is cut out and a coil tension spring extends across the opening. In this way, the spring engages the handle and biases the handle of the tool or cleaning implement into friction-holding engagement with the tubular member.

Breveglieri discloses the use of a quick release adjustable holding device which is mounted into a slot to adjustably grasp, by gravity, cylindrical handles of different diameter. Both the apparatus of Breveglieri and Liesinger require a support bracket and means for grasping the cylindrical handle which includes either a spring or some other friction device. The biasing means or friction means may wear with time and result in failure of the device to support heavier cleaning devices or tools such as a wet rag mop.

Gage (U.S. Pat. No. 2,441,697) discloses a wet mop stand which overcomes the problem of slippage in such devices as disclosed by Breveglieri and Liesinger which support the tool or implement by frictional contact with the cylindrical handle. The device disclosed by Gage utilizes a grid on which the rag mop portion of the mop is supported above a tray for capturing and holding liquid which drains from the wet mop head. The device of Gage, however, requires an amount of floor space to locate the mop stand.

Stacy, Sr. (U.S. Pat. No. 3,780,874) also discloses a mop stand or utility tree which incorporates a tray or pan which captures the dripping liquid from a wet mop. With the device of Stacy, Sr., an amount of floor space is also required for storing the utility tree. Further, the device of Stacy, Sr. utilizes a rotating gear mechanism to rotate and friction fit against the cylindrical handle of the mop in order to support it above the surface of the tray. This mechanism is subject to wear.

The device of Gage, although not requiring a mechanism to suspend the mop by the handle, does require a grid on which the mop head is heaped. It is believed such configuration may prevent efficient drying of the mop head. This could result in mop head rot and the growth of bacteria due to extended drying time, resulting in the need for more frequent replacement of the mop.

Accordingly, the need exists for a mop support or stand which does not utilize springs, biasing means or other adjustable sliding friction mechanism to support the mop. Further, there is a need for a mop support which holds the mop above a catch basin yet does not utilize additional floor space. Finally, the mop support should incorporate features which hold a mop with the mop head strands hanging freely to their full length to hasten drying and to prevent mop head rot.

The present invention addresses these needs as well as other problems associated with existing mop supports. The present invention also offers further advantages over the prior art and solves problems associated therewith.

SUMMARY OF THE INVENTION

The present invention is a mop holder or support which is specifically designed to suspend and hold a wet mop above a basin or utility sink, which can commonly be found in a custodial storage area of office buildings, schools, hospitals and other commercial properties. The mop holder does not utilize any springs or other biased or slidable friction means for supporting the mop which may be insufficient to support a wet mop or wear and fail with time. Instead, the mop holder of the present invention incorporates two generally vertically-spaced members which are wall-mounted at a location above a utility sink or other basin with the mop strands freely hanging to allow the mop head to drain and dry properly. The device provides a simple apparatus which is economical, yet solves problems associated with prior art devices.

The wall-mounted mop holder of the present invention includes an upper support member which has a first backing plate for affixing the support member to a wall. The first backing plate includes means for supporting an elongated handle of a mop in a generally vertical position projecting outwardly from the wall.

The first backing plate has a first planar surface and a second opposing planar surface for affixing the upper support member to a vertical surface in planar contact with the second opposing surface. The means for supporting the elongated handle in a generally vertical position projects outwardly from the first planar surface when the upper support member is affixed to a vertical surface. The backing plate can have at least one hole therethrough for securing the upper support member to the vertical surface with commonly known fasteners.

In one embodiment, the means for supporting the elongated handle includes a generally rectangular member extending outwardly from a backing plate. The generally rectangular member has an upper and lower planar surface lying in a generally horizontal plane when the upper support member is affixed to a wall or vertical surface. The generally rectangular member further has at least one hole extending through the upper and lower planar surfaces to receive the elongated handle of a mop. The generally rectangular member is preferably formed integrally with the first backing plate. Although not required, the backing plate and rectangular member could be formed from a single piece of sheet material by bending at a point intermediate to the angle of approximately 90° to form the vertical backing plate and rectangular member extending perpendicular therefrom.

Thus the upper support member can comprise and angular bracket formed through bending a rectangular piece of sheet material which when wall mounted includes a vertical backing up plate and generally horizontal rectangular member extending outwardly therefrom. It is believed that this would be the most economical way to manufacture the upper supported bracket.

In another embodiment, the means for supporting the elongated handle includes a first ring having a hole therethrough. The inside diameter of the ring is greater than the outside diameter of the elongated handle. The first ring is fixedly mounted to the first backing plate in a position so that the diameter of the ring lies in a generally horizontal planar surface projected outwardly from the first backing plate as affixed to the wall. Thus, the ring is fixedly mounted to the first surface of the upper support member and projects outwardly from the first planar surface when the upper support member is affixed to the vertical surface or wall.

The upper support member of the mop holder can also include a second ring fixedly connected proximate the outside diameter surface of the second ring to the outside diameter surface of the first ring in a position so that a second elongated handle may be supported therethrough in a generally vertical position. The second ring is preferably connected to the first ring at a point proximate a line extending generally perpendicular to the first backing plate through the radial centerpoint of the first ring and the radial centerpoint of the second ring. In this way, the two mops are spaced horizontally and outwardly from the wall or vertical surface when supported thereon. Thus, in a preferred embodiment, a line extending generally perpendicular to the first surface of the upper support member passes through the radial centerpoint of both the first ring and the second ring.

The wall-mounted mop holder of the present invention includes a lower support member which has a second backing plate for affixing the lower support member to the wall. The backing plate includes means for supporting a mop head fixedly attached and projecting outwardly therefrom. In use, the upper support member and the lower support member are mounted to the wall or generally vertical surface at a distance spaced generally vertically so that the upper and lower members cooperate to support both the elongated handle and the mop head of the mop.

The lower support member includes a second backing plate having a first planar surface and a second opposing planar surface for affixing the lower support member to the vertical surface in planar contact with the second opposing surface. The second backing plate can also have at least one hole therethrough for mounting the lower support member to a wall or vertical surface utilizing commonly known fasteners.

The means for supporting a mop head can include at least one tine extending perpendicular outwardly from the second backing plate of the lower support member as mounted on a wall. Thus, the at least one tine extends perpendicular outwardly from the first surface of the lower support member. The lower support member can also include a first and a second tine spaced generally horizontally from one another and extending generally perpendicular outwardly from the first surface of the lower support member for receiving and supporting the mop head at two points. The tines of the present invention can each comprise a rod having a first and a second end. The rod can be fixedly connected on the first end to the second backing plate of the lower support member and include an angular offset proximate the second end of the rod for preventing the mop head from sliding off the tines.

Both the upper support member and the lower support member are preferably manufactured from stainless steel. This prevents oxidation due to contact with liquid. However, it is recognized that other materials may be utilized such as an epoxy-coated or otherwise coated carbon steel. Further, any polymer of sufficient strength could be utilized for each member.

These and various other advantages and features of novelty which characterize the present invention are pointed out with particularity in the claims annexed hereto and forming a part hereof. However, for a better understanding of the invention, its advantages, and the object obtained by its use, reference should be made to the drawings which form a further part hereof, and to the accompanying descriptive matter in which there are illustrated and described preferred embodiments of the present invention.

BRIEF DESCRIPTION OF THE DRAWINGS

In the drawings, in which like reference numerals indicate corresponding parts or elements of preferred embodiments of the present invention throughout the several views.

DETAILED DESCRIPTION OF THE INVENTION

Detailed embodiments of the present invention are disclosed herein. However, it is to be understood that the disclosed embodiments are merely exemplary of the present invention which may be embodied in various systems. Therefore, specific details disclosed herein are not to be interpreted as limiting, but rather as a basis for the claims and as a representative basis for teaching one of skill in the art to variously practice the invention.

Figure 1:
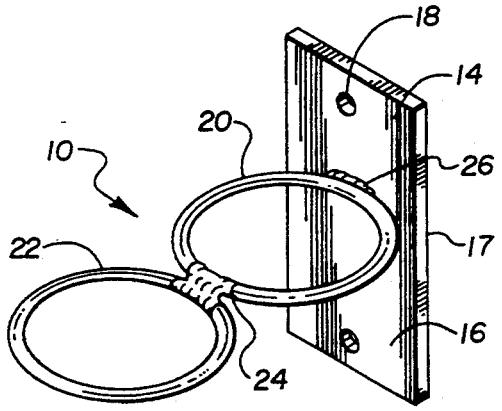
FIG. 1 is a perspective view of the upper support member of the mop holder of the present invention.
Figure 2:
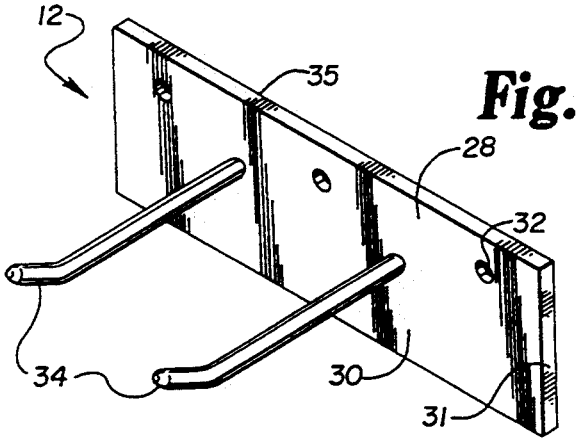
FIG. 2 is a perspective view of the lower support member of the mop holder of the present invention.
Figure 3:
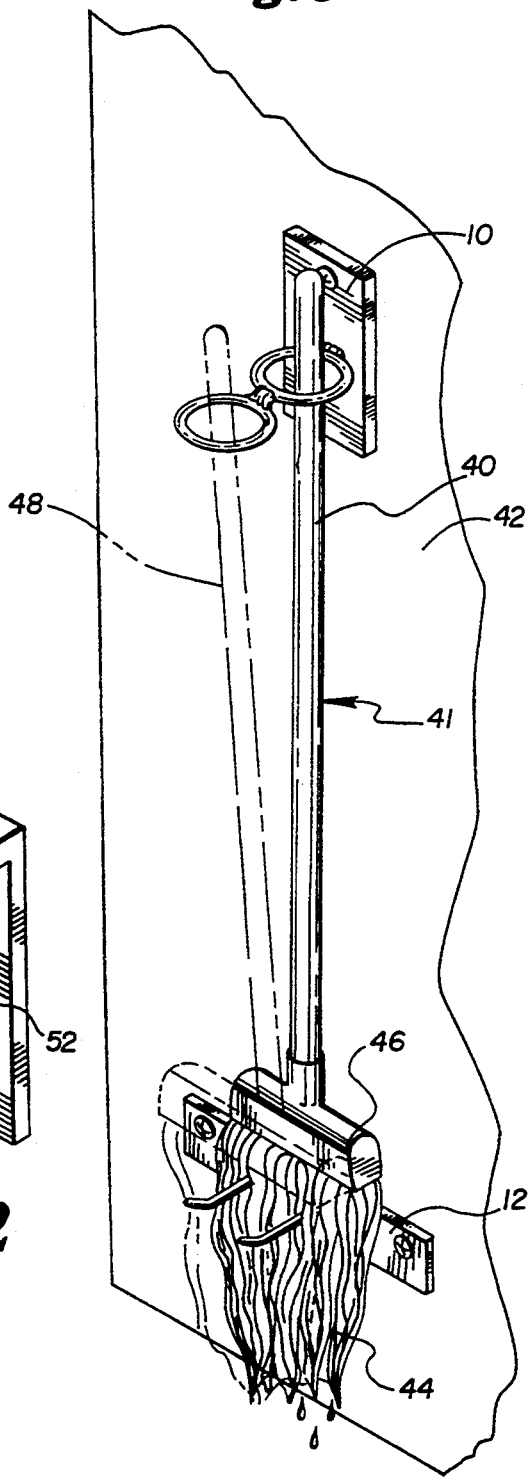
FIG. 3 is a perspective view of the upper and lower support members as mounted on a vertical surface with a first mop and a second mop supported thereon.

Referring now to the figures, FIG. 1 illustrates a perspective view of a preferred embodiment of the upper support member 10 of the present invention. FIG. 2 illustrates a perspective view of a preferred embodiment of the lower support member 12 of the present invention. FIG. 3 depicts the upper support member 10 and lower support member 12 as mounted on a vertical surface or wall 42. As illustrated in FIG. 3, the upper support member 10 and lower support member 12 cooperate to support a mop 41 in a generally vertical position with the upper support member 10 supporting the elongated cylindrical handle 40 of the mop and the lower support member 12 supporting a mop head 46 of the mop. The strands or rag 44 of the mop are freely suspended to hang vertically downward from the lower support member 12 for drainage and drying.

In a preferred embodiment, as depicted in FIG. 3, a second mop 48 is shown in phantom to illustrate the way in which multiple mops may be supported in the same mop holder.

As depicted in FIG. 1, the upper support member 10 includes a first backing plate 14 for affixing the upper support member 10 to a wall or vertical surface 42. The first backing plate 14 has a first planar surface 16 and a second opposing planar surface 17. The upper support member 10 is affixed to a vertical surface 42 in planar contact with the second opposing surface 17.

The first planar surface 16 has means for supporting the elongated handle 40 of the mop 41 in a generally vertical position projecting outwardly from the first planar surface 16. Thus, the means for supporting the elongated handle in a generally vertical position projects outwardly from the first backing plate 14 as mounted on the wall 42.

In one embodiment, the means for supporting the elongated handle 40 includes at least a first ring 20 having a hole therethrough with an inside diameter greater than the outside diameter of the elongated handle 40. The first ring 20 is fixedly mounted to the first backing plate 14 or first surface 16 of the first backing plate 14. The first ring 20 is positioned so that the diameter of the first ring 20 lies in a generally horizontal planar surface projected outwardly from the first surface 16 or first backing plate 14 as affixed to the vertical surface or wall 42.

The mop holder of the present invention can also include a second ring 22 fixedly connected proximate the outside diameter surface of the second ring 22 to the outside diameter surface of the first ring 20 in a position so that a second elongated handle 40 may be supported therethrough in a generally vertical position. The second ring 22 is preferably fixedly connected to the first ring 20 at a point proximate a line extending generally perpendicular to the first surface 16 of the first backing plate 14 through the radial center point of the first ring 20 and the radial centerpoint of the second ring 22.

Figure 1A:
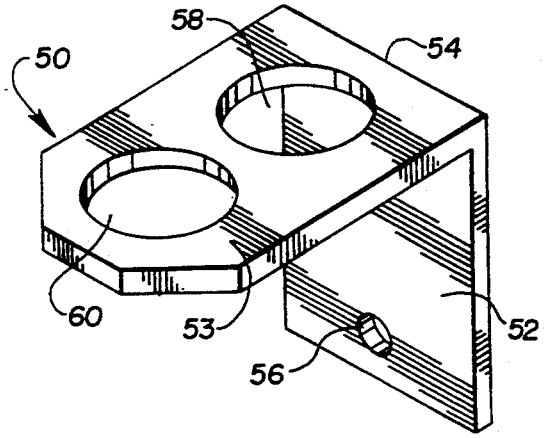
FIG. 1A is a perspective view of an alternative upper support member of the mop holder of the present invention.

FIG. 1A depicts a preferred embodiments of the upper bracket 50 which is believed to be the most economical way to manufacture the upper bracket 50. The upper bracket 50 includes a backing plate 52 and generally rectangular member 53. The backing plate 52 and generally rectangular member 53 are preferably formed integrally. This may be done by utilizing a single piece of metal or other sheet material and bending at a point intermediate 54 to form an angular bracket. The angular bracket thus formed defines both the backing plate 52 and rectangular member 53.

The generally rectangular member 53 includes both an upper and lower planar surface when mounted on a vertical surface or wall. The means for supporting the elongated handle in such embodiment includes at least one hole 58 extending through the rectangular member 53 from the upper planar surface through the lower planar surface. A second hole 60 may also be included to support multiple handles. At least one hole 56 can be provided through the backing plate 52 to aid in mounting the angular bracket 50.

It is to be understood that although rings 20, 22 are utilized as a means for supporting the elongated handle, any shape could be utilized, such as a square or rectangle. However, with any means of the present invention, biasing means such as springs or other friction fittings are preferably not utilized.

The upper support member 10 can also include at least one hole 18 extending through the backing plate 14. The hole 18 can be utilized to affix the upper support member to the vertical surface 42 utilizing commonly known fasteners.

Referring now again to FIG. 2, the lower support member 12 includes a second backing plate 30. The second backing plate 30 has a first planar surface 31 and a second opposing planar surface 35. The backing plate 30 is used for affixing the lower support member 12 to the vertical surface or wall 42 in planar contact with the second opposing surface 35. The second backing plate 30 includes means for supporting a mop head fixedly attached and projecting outwardly therefrom. Thus, the means for supporting the mop head project outwardly from the first planar surface 31 of the second backing plate 30 as mounted on a wall or vertical surface 42. In use, the upper support member 10 and lower support member 12 are mounted to the vertical surface 42 at a distance spaced generally vertically so that the members cooperate to support both the elongated handle 40 and the head 46 of the mop 41.

The means for supporting the mop head can include at least one tine 34 extending generally perpendicular outwardly from the second backing plate 30 or first surface 31 of the second backing plate 30 of the lower support member 12. The lower support member 12 can also include a first and a second tine 34 spaced generally horizontally and extending perpendicular outwardly from the second backing plate 30 as mounted on a wall or vertical surface 42. The tines 34 are utilized to receive and support the mop head 46 at two points as depicted in FIG. 3. In a preferred embodiment, the first and second tine 34 each comprise a rod having a first and second end. The rod is fixedly connected on the first end to the first surface 31 of the second backing plate 30. The second end of the rod can include an angular offset proximate the second end for preventing the mop head 46 from sliding off the tines 34.

Thus, in a preferred embodiment, the first and second tines 34 extend generally perpendicular outwardly from the first surface 31 of the lower support member 12 to cooperatively receive and support the mop head 46 of the mop 41 at two points. With this embodiment, the strands or rag of the mop 44 dangle freely to maximize drying.

The mop holder of the present invention is preferably mounted above a utility sink which is commonly found in janitorial storage areas, particularly in office buildings, schools, hospitals and other public facilities or commercial property. Thus, mops may be stored in the mop holder at a location which does not utilize any floor area in a condition in which the mop may completely dry while the dripping liquid falls into the utility sink rather than on the floor. In this way, it is believed the mop head life will be extended and growth of bacteria will be prevented. Further, the simple design allows for one-handed storage of the mop within the mop holder.

New characteristics and advantages of the invention covered by this document have been set forth in the foregoing description. It will be understood, however, that this disclosure is, in many respects, only illustrative. Changes may be made in details, particularly in matters of shape, size, and arrangement of parts, without exceeding the scope of the invention. The scope of the invention is, of course, defined in the language in which the appended claims are expressed.

What is claimed is:

1. A wall-mounted mop holder comprising:

(a) an upper support member including means for supporting an elongated handle of a mop in a generally vertical position projecting outwardly therefrom, wherein said upper support member includes an angular bracket defining a generally vertical surface and a generally horizontal surface when mounted on a wall and said means for supporting an elongated handle of a mop include at least one hole bored through said horizontal surface; and (b) a lower support member including means for supporting a mop head fixedly attached and projecting outwardly therefrom, wherein said upper support member and said lower support member are mounted to a vertical surface at a distance spaced generally vertically so that said members cooperate to support both said elongated handle and said mop head of said mop.

2. A wall-mounted mop holder comprising:

(a) an upper support member including means for supporting an elongated handle of a mop in a generally vertical position projecting outwardly therefrom, wherein said means for supporting said elongated handle includes at least a first ring having a hole therethrough with a diameter greater than the diameter of said elongated handle, said first ring fixedly mounted to said upper support member in a position so that the diameter of said ring lies in a generally horizontal planar surface projected outwardly from said upper support member as affixed to said vertical surface; and (b) a lower support member including means for supporting a mop head fixedly attached and projecting outwardly therefrom, wherein said upper support member and said lower support member are mounted to a vertical surface at a distance spaced generally vertically so that said members cooperate to support both said elongated handle and said mop head of said mop.

3. The apparatus of claim 2, further comprising a second ring fixedly connected proximate the outside diameter surface of said second ring to the outside diameter surface of said first ring in a position so that a second elongated handle may be supported therethrough in a generally vertical position.

4. The apparatus of claim 3, wherein said second ring is fixedly connected to said first ring at a point proximate a line extending generally perpendicular to said upper support member through the radial centerpoint of said first ring and the radial centerpoint of said second ring.

5. The apparatus of claim 1, wherein said means for supporting a mop head include at least one tine extending generally perpendicular outward from said lower support member.

6. The apparatus of claim 1, wherein said means for supporting said head include a first and a second tine spaced generally horizontally and extending generally perpendicular outwardly from said lower support member as mounted on said vertical surface for receiving and supporting said mop head at two points.

7. The apparatus of claim 5, wherein said first and said second tine each comprise a rod having a first and a second end, said rod fixedly connected proximate said first end to said lower support member and said rod further having an angular offset proximate said second end for preventing said mop head from sliding off said tines.

8. The apparatus of claim 1, wherein said upper and said lower support members are manufactured from stainless steel.

9. An apparatus for supporting at least one mop, said mop having an elongated handle and a head, said apparatus comprising:

(a) an upper support member, said upper support member including a first backing plate having a first planar surface and a second opposing planar surface for affixing said upper support member to a vertical surface in planar contact with said second opposing surface, said first planar surface having means for supporting said elongated handle in a generally vertical position projecting outwardly from said first planar surface, wherein said means for supporting said elongated handle includes at least a first ring having a hole therethrough, with a diameter greater than the diameter of said elongated handle, fixedly mounted to said first surface of said upper support member in a position so that the diameter of said ring lies in a generally horizontal planar surface projected outwardly from said first planar surface when said upper support member is affixed to said vertical surface; and (b) a lower support member, said lower support member including a second backing plate having a first planar surface and a second opposing planar surface for affixing said lower support member to said vertical surface in planar contact with said second opposing surface, said first planar surface having means for supporting said head fixedly attached and projecting outwardly from said first planar surface wherein, in use, said upper support member and said lower support member are mounted to said vertical surface at a distance spaced generally vertically so that said members cooperate to support both said elongated handle and said head of said mop.

10. An apparatus for supporting at least one mop, said mop having an elongated handle and a head, said apparatus comprising:

(a) an upper support member, said upper support member including a first backing plate having a first planar surface and a second opposing planar surface for affixing said upper support member to a vertical surface in planar contact with said second opposing surface, said first planar surface having means for supporting said elongated handle in a generally vertical position projecting outwardly from said first planar surface; and (b) a lower support member, said lower support member including a second backing plate having a first planar surface and a second opposing planar surface for affixing said lower support member to said vertical surface in planar contact with said second opposing surface, said first planar surface having means for supporting said head fixedly attached and projecting outwardly from said first planar surface, wherein said means for supporting said head include at least one tine extending generally perpendicular outwardly from said first surface of said lower support member wherein, in use, said upper support member and said lower support member are mounted to said vertical surface at a distance spaced generally vertically so that said members cooperate to support both said elongated handle and said head of said mop.

11. The apparatus of claim 10, wherein said means for supporting said head include a first and a second tine spaced generally horizontally and extending generally perpendicular outwardly from said first surface of said lower support member for receiving and supporting said mop head at two points.

12. An apparatus for supporting at least one mop, said mop having an elongated handle and a head, said apparatus comprising:

(a) an upper support member, said upper support member including a first backing plate having a first planar surface, a second opposing planar surface and at least one hole therethrough for affixing said upper support member to a wall surface in planar contact with said second opposing surface, said first planar surface having a generally rectangular member extending outwardly therefrom having an upper and lower planar surface lying in a generally horizontal plane when said upper support member is affixed to said wall surface, said generally rectangular member having at least one hole extending through said upper and lower planar surfaces; and (b) a lower support member, said lower support member including a second backing plate having a first planar surface, a second opposing planar surface and at least one hole therethrough for affixing said lower support member to said wall surface in planar contact with said second opposing surface, said first planar surface further having at least one tine fixedly attached and projecting outwardly from said first planar surface, wherein in use said upper support member and said lower support member are mounted to said wall surface at a distance spaced generally vertically so that said members cooperate to support both said elongated handle in said upper support member and said head of said mop on said lower support member.

13. The apparatus of claim 12, wherein said generally rectangular member is formed integrally with said first backing plate.

14. The apparatus of claim 13, wherein said upper support member comprises an angular bracket formed through bending a rectangular piece of sheet material to an angle of approximately 90° said backing plate and generally rectangular member.

15. The apparatus of claim 12, wherein a second tine is spaced generally horizontally from said first tine, said first and second tines extending generally perpendicular outwardly from said first surface of said lower support member to cooperatively receive and support said mop head of said at least one mop at two points.

16. The apparatus of claim 15, wherein said first and said second tines each comprise a rod having a first and a second end, said rod fixedly connected on said first end to said first surface of said lower support member and said rod having an angular offset proximate said second end for preventing said mop head from sliding off said tines.

* * * * *